United States Patent [19]

Brown

[11] 4,176,537

[45] Dec. 4, 1979

[54] METHOD OF AND MEANS FOR STRAIGHTENING BARS AND TUBES

[75] Inventor: Arthur N. Brown, Stourbridge, England

[73] Assignee: The Bronx Engineering Company, Ltd., Stourbridge, England

[21] Appl. No.: 892,160

[22] Filed: Mar. 31, 1978

[30] Foreign Application Priority Data

May 5, 1977 [GB] United Kingdom ..... 18825/77

[51] Int. Cl.[2] ..... B21D 3/04

[52] U.S. Cl. ..... 72/98; 72/99

[58] Field of Search ..... 72/98, 99, 78, 95, 96, 72/100; 140/147

[56] References Cited

U.S. PATENT DOCUMENTS

| | | | |
|---|---|---|---|
| 2,438,240 | 3/1948 | Trudeau | 72/99 |

FOREIGN PATENT DOCUMENTS

| | | | |
|---|---|---|---|
| 508209 | 9/1930 | Fed. Rep. of Germany | 72/98 |
| 2538021 | 3/1977 | Fed. Rep. of Germany | 72/98 |
| 460890 | 12/1950 | Italy | 72/99 |
| 138851 | 1/1953 | Sweden | 72/99 |
| 360029 | 9/1973 | Sweden | 72/99 |
| 362367 | 12/1973 | Sweden | 72/78 |
| 909192 | 10/1962 | United Kingdom | 140/147 |
| 909434 | 10/1962 | United Kingdom | 72/98 |

*Primary Examiner*—Lowell A. Larson

*Attorney, Agent, or Firm*—Klarquist, Sparkman, Campbell, Leigh, Hall & Whinston

[57] ABSTRACT

A bar straightening machine comprises a pair of rolls between which there is defined a path including two bends along which bar to be straightened is passed. The rolls are preferably of identical form, each comprising a first end portion of hyperbolic form, a second end portion also of hyperbolic form and an intermediate portion which merges smoothly with the end portions. The hyperbola from which one end portion is generated differs from the hyperbola from which the other end portion is generated, one end portion having a diameter somewhat greater than the corresponding diameter of the other end portion. The rolls are arranged with identical end portions remote from each other.

11 Claims, 3 Drawing Figures

METHOD OF AND MEANS FOR STRAIGHTENING BARS AND TUBES

BACKGROUND TO THE INVENTION

From one aspect this invention relates to a straightening machine suitable for straightening bars. Bar straightening machines usually comprise at least two rolls between which a bar is passed, the rolls exerting on the bar a bending moment sufficient to cause plastic flow of the material of which the bar is formed. The bar is rotated as it passes between the rolls so that the stress to which each part of the bar is subjected is reversed at least once and usually a number of times as that part of the bar passes between the rolls. Because tubes can be deformed more easily than bars, owing to partial collapse of a tube, tube straightening machines usually comprise several pairs of rolls; whereas bar straightening machines usually comprise only a single pair of rolls. However, it will be understood that a bar straightening machine may be used for straightening either bar or tube and that a tube straightening machine may similarly be used for straightening either bar or tube.

Both of the bar-engaging rolls of a bar straightening machine are normally driven and arranged with their respective axes inclined to the path along which the bar is moved, so that the rolls cause the bar to advance along the path and also to rotate about its axis.

At any given moment a certain length of a bar which is being straightened in a bar straightening machine is stressed beyond its elastic limit. This length is called the plastic length. Experience has shown that the plastic length affects the accuracy with which a bar is straightened. In general, the greater the plastic length, the straighter the resulting bar.

SUMMARY OF THE INVENTION

According to a first aspect of the invention, there is provided a straightening machine comprising a pair of rolls between which there is defined a non-rectilinear path along which elongate material to be straightened is passed, wherein said path between the rolls includes two bends.

By a bend, we mean a curved portion of the path, within which portion the curvature increases and then decreases along the path.

The formation of two bends in a bar which travels along the path defined between the rolls results in a longer plastic length than is achieved under similar conditions with a known two-roll bar straightening machine which forms in the bar passing between the rolls a single bend.

According to a second aspect of the invention, there is provided a straightening machine comprising a roll having an axis and a bar-engaging surface, the roll being mounted for rotation about its axis and the machine further comprising means for maintaining in contact with said bar-engaging surface a bar which in use, is passed through the machine along a path inclined to said axis, wherein a plane which is inclined to said axis and contains a longitudinal centreline of said path intersects said bar-engaging surface along a non-rectilinear line and said line includes two bends.

The bar-engaging surface of the roll preferably includes first and second axially spaced portions, each of said portions being a respective surface of revolution about the axis of the roll, said first portion having a generatrix which forms a part of an hyperbola and said second portion having a generatrix which forms a part of another hyperbola.

The means for maintaining a bar in contact with the bar-engaging surface of the roll is preferably a further roll and drive means may be provided for driving both rolls.

It is usual to provide drive means for driving both rolls in a two-roll bar straightening machine and to provide an electrical control system which divides the energy input to the machine approximately equally between the two rolls so that the maximum power which the machine can apply to a bar can be approximately equal to twice the maximum power output of each electrical motor provided for driving respective ones of the rolls. Because, in known two-roll bar straightening machines, the rolls have respective different forms, the respective torques applied to the bar by the rolls tend to be unequal, unless a suitable power sharing electrical control system is provided. Such control system is complex and expensive.

In the preferred machine according to the present invention where a further roll is provided for maintaining the bar in contact with said bar-engaging surface and both rolls are driven, the rolls are substantially identical. Identical rolls tend to apply identical torques to a particular bar which is being straightened, so that the power consumption of the respective motors driving the rolls tends to be approximately equal.

According to a third aspect of the invention, there is provided a roll for use in a machine according to the first aspect, the roll having a form such that, when mounted in the machine directly opposite to an identical roll, the rolls define between them a path along which material to be straightened is passed and the path includes two bends.

The rolls are directly opposite each other when respective medial planes of the rolls, each of which planes is perpendicular to the axis of rotation of the associated roll and is midway between the ends of the rolls, intersect along a line which itself intersects the centreline of the path defined between the rolls.

According to a fourth aspect of the invention, there is provided a roll having an axis and comprising first and second portions which are spaced apart axially and each of which portions has a peripheral surface which is a respective surface of revolution about the axis, wherein the first portion has a generatrix which is a part of an hyperbola and the generatrix of the second portion is a part of another hyperbola.

According to a further aspect of the invention, there is provided a method of straightening elongate material having a circular profile wherein the material is passed along a path defined between a pair of rolls, the material is rotated about its own axis by the rolls and the material is bent by said rolls in opposite directions at two positions along said path.

BRIEF DESCRIPTION OF THE DRAWINGS

The invention will now be described, by way of example, with reference to the accompanying drawing wherein.

DESCRIPTION OF THE PREFERRED EMBODIMENT

Figure 1:
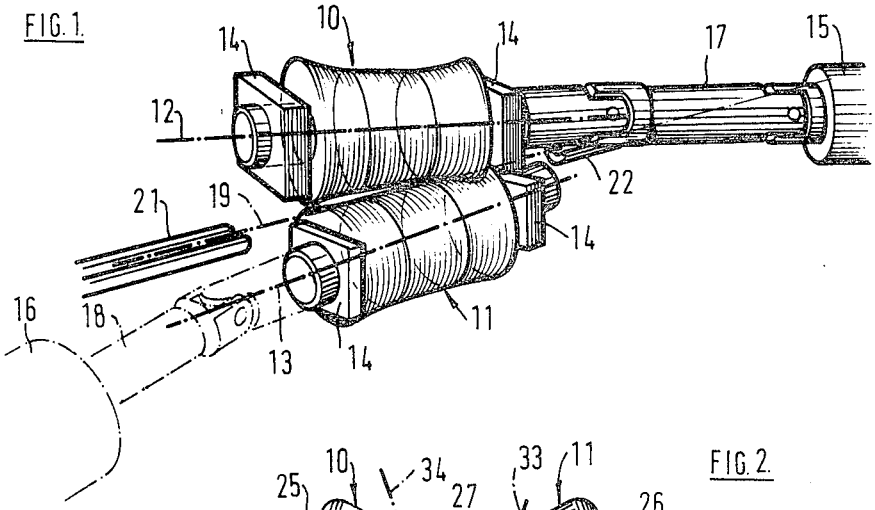
FIG. 1 shows diagrammatically a perspective view of a bar straightening machine in accordance with the invention, certain parts being omitted for clarity.

The machine illustrated in FIG. 1 is a two-roll bar straightening machine having upper and lower bar-engaging rolls 10 and 11 respectively. The rolls are supported with their respective axes 12 and 13 horizontal by bearings 14 at each end of each roll. The structure which supports the bearings is the same as that provided in two-roll bar straightening machines commonly in use at the present time and need not be particularly described herein. At least one of the rolls is movable vertically towards and away from the other roll, to vary the gap between the rolls.

For driving the rolls 10 and 11, there are provided respective electric motors 15 and 16. The motor 15 is connected with the roll 10 by a shaft 17 which includes at least two universal joints. The motor 16 is connected with the roll 11 by a shaft 16, also comprising universal joints.

Figure 2:
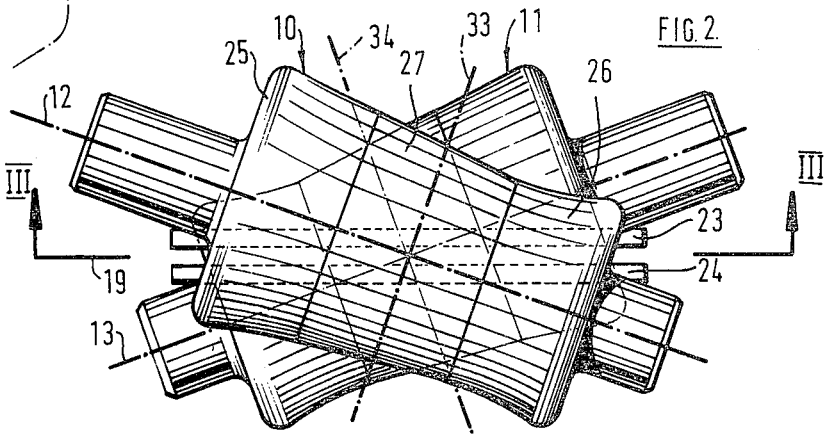
FIG. 2 shows on an enlarged scale a plan view of bar-engaging rolls and bar guides of the machine.

As shown in FIG. 2, the roll 10 is arranged with its axis 12 inclined at an acute angle to a medial plane 19 of the machine. The roll 11 is arranged with its axis 13 inclined to the plane 19 at the same acute angle but in the opposite direction. The medial plane of the machine bisects the angle between the axes 12 and 13. The structure supporting the bearings 14 may be adapted to permit of the adjustment of the angle of inclination of the axes 12 and 13 to the plane 19 in the well known manner.

Guide means is provided for guiding a bar towards the rolls 10 and 11 along an infeed path such that the axis of a bar on the infeed path coincides with the medial plane 19. The guide means is also arranged for guiding a bar leaving the rolls 10 and 11 along an output path such that the axis of a bar on the output path coincides with the medial plane 19. The guide means shown in the accompanying drawing includes an upstream guide trough 21 defining the infeed path. Adjacent to the downstream ends of the rolls 10 and 11 there is a further guide trough 22 which defines the output path.

The guide means further comprises a pair of plates 23, 24 (not shown in FIGS. 1 and 3) which are approximately horizontal and disposed one on each side of the medial plane 19 at a level between the axes 18 and 20 of the rolls. These plates have respective operative edges which lie between the rolls 10 and 11 and define opposite lateral boundaries of a path along which a bar passes between the rolls. The guide plates guide the leading end of a bar along the required path from the upstream guide trough 21 to the downstream guide trough 22. They also maintain on the required path the trailing end of a bar after such trailing end has left the upstream guide trough 21.

The rolls 10 and 11 are identical and have a profile which is illustrated in FIG. 2. For the purpose of clarity of illustration, the shape of the profile is exaggerated in FIG. 2. The bar-engaging surface of the roll 10 comprises three portions, namely a large end portion 25, a small end portion 26 and an intermediate portion 27. The large end portion of the roll-engaging surface is generated by revolution of a part of an hyperbola about the axis 12 of the roll. The diameter $d_1$ of the surface portion 25 adjacent to the end of the roll is greater than the diameter $d_2$ at the junction between the surface portions 25 and 27. The smaller end portion 26 of the bar-engaging surface is also generated by revolution of a part of an hyperbola about the axis of the roll but the hyperbola from which the surface portion 26 is generated lies nearer to the axis 12 than does the hyperbola from which the surface portion 25 is generated. Thus, the diameter $d_3$ of the roll at the junction between the surface portions 26 and 27 is slightly less than the diameter $d_2$ and the diameter $d_4$ of the surface portion 26 adjacent to the end of the roll is slightly less than the diameter $d_1$. The diameter of the roll along the intermediate surface portion 27 changes gradually from the diameter $d_2$ to the diameter $d_3$ so that the intermediate surface portion has a substantially frusto-conical shape which differs from an exactly frusto-conical shape sufficiently to merge smoothly with the surface portions 25 and 26.

The large end portion 25 of the roll 10 is situated adjacent to the smaller end portion of the roll 11 and vice versa. The rolls are directly opposite to each other, that is the medial plane 33 of the roll 10 intersects the medial plane 34 of the roll 11 along a vertical straight line which lies in the medial plane 19 of the machine and intersects at a central point of the machine the centerline of the path along which bars pass through the machine. The axes 12 and 13 of the rolls also intersect this vertical line which passes through the central point of the machine.

Figure 3:
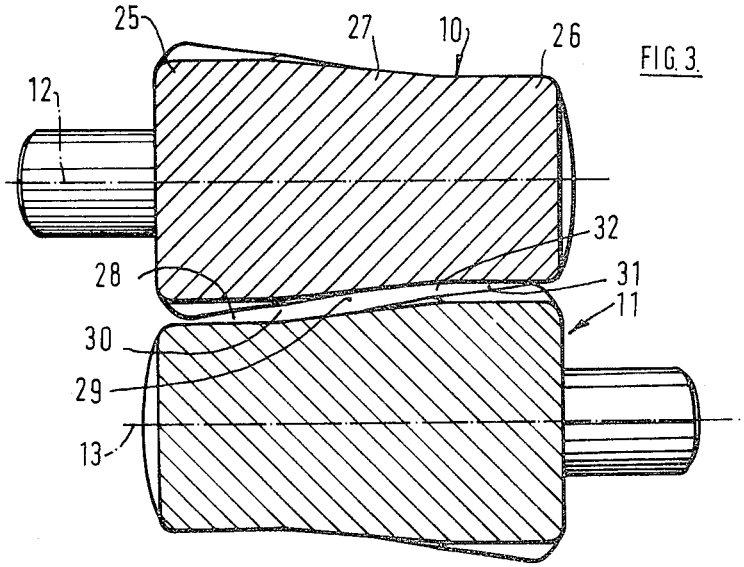
FIG. 3 shows a cross section of the rolls in a medial plane of the machine indicated by the line III—III in FIG. 2.

From FIG. 3, it can be seen that the path along which a bar travels between the rolls 10 and 11 comprises a first end portion 28 which is rectilinear and horizontal, an intermediate portion 29 which is rectilinear and inclined upwardly, an upward bend 30 connecting the portions 28 and 29, a second portion 31 which is also rectilinear and horizontal and a downward bend 32 connecting the portions 29 and 31.

The change in direction of the path at the bends 30 and 32 is exaggerated in FIG. 3, as is the distance by which the rectilinear portions 28 and 31 of the path are offset from one another. The respective forms of the surface portions 25 and 26 may differ somewhat from surfaces generated by revolution of an hyperbola. For example, the end portions of the bar-engaging surface of each roll may be substantially cylindrical, the surface portion at one end of each roll having a diameter somewhat greater than that of the surface portion at the other end of the roll.

In use of the machine, the rolls 10 and 11 are rotated in directions such that both rolls tend to rotate a bar which is engaged between them in the same direction and simultaneously to advance the bar along the feed path. As each part of a bar passes along the path between the rolls, it is bent whilst on the portion 30 of the path and is bent again whilst on the portion 32 of the path.

A bar which is being straightened is stressed beyond its plastic limit both in the vicinity of the portion 30 of the path and in the vicinity of the portion 32. The plastic length of the bar is greater than is the plastic length which would exist if the same bar were straightened in a known two roll straightening machine which establishes a single bend in the bar.

It will be noted that the bends 30 and 32 are in opposite directions, so that a bar being straightened approaches the rolls 10 and 11 along a horizontal path and leaves the rolls along a horizontal path. Furthermore, the bends both lie in the medial plane 19 of the machine so that the centreline of a bar which is being straightened remains within that medial plane.

The bar-engaging surface of the roll 10 illustrated in the accompanying drawing is continuous along the length of the roll. It would also be within the scope of the invention for the bar-engaging surface of one of the rolls to be interrupted along the length of that roll. Separate parts of the surface could be formed on structurally separate roll parts which rotate about a common axis, either together or at somewhat different speeds. The roll 11 maintains the bar in contact with the bar-engaging surface of the roll 10 so that the bar is constrained to follow a path which conforms to the profile of the bar-engaging surface. Similarly, the function of the roll 10 can be regarded as that of maintaining the bar in contact with the bar-engaging surface of the roll 11 so that the bar is constrained to follow a path which conforms to the shape of the surface of the roll 11.

Since the rolls 10 and 11 are identical, the respective torques applied to the bar by each of the rolls tend to be substantially the same even without the use of electrical control means for dividing the electrical power supplied to the machine equally between the motors 15 and 16. Furthermore, the rolls tend to have an equal but opposite twisting effect on the bar, tending to twist the bar in a horizontal plane, so that excessive wear of the guide plates 23 and 24 is avoided.

Because the rolls 10 and 11 are identical, they are set with their respective axes 12 and 13 inclined at the same angle to the plane 19. It is envisaged that bars of different diameters may be straightened with the rolls 10 and 11 set at the same angle to the plane 19.

I claim:

1. In a straightening machine comprising a pair of rolls between which there is defined a non-rectilinear path along which elongate material to be straightened is passed, said rolls are rotatable about respective axes and said axes are inclined to each other and to said path, whereby rotation of the rolls in the same direction about their axes causes the elongate material to move along said path and to rotate about its own longitudinal axis, the improvement wherein said path includes two bends and said bends lie in the same plane.

2. The improvement according to claim 1 wherein said bends are in opposite directions.

3. The improvement according to claim 2 wherein said rolls have respective forms which are substantially identical and said bends are substantially identical but opposite.

4. In a straightening machine comprising a roll having an axis and a bar-engaging surface, the roll being mounted for rotation about its axis and the machine further comprising means for maintaining in contact with said bar-engaging surface a bar which, in use, is passed through the machine along a path inclined to said axis, the improvement wherein said bar engaging surface intersects along a non-rectilinear line a plane which is inclined to said axis and which contains entirely a longitudinal centerline of said path and wherein said non-rectilinear line includes two bends.

5. The improvement according to claim 4 wherein the bar-engaging surface of the roll includes two axially-spaced portions, each of said portions is a respective surface of revolution about the axis of the roll, said first portion has a generatrix which is a part of an hyperbola and said second portion has a generatrix which is a part of another hyperbola.

6. The improvement according to claim 5 wherein said means for maintaining in contact with said surface is in the form of a second roll and the second roll has a bar-engaging surface which includes two axially spaced portions, each of said portions is a respective surface of revolution about an axis of the second roll, a first of said portions has a generatrix which is a part of an hyperbola and the generatrix of a second of said portions is a part of another hyperbola.

7. The improvement according to claim 6 wherein the bar-engaging surface of each roll is continuous and includes an intermediate portion merging smoothly with the axially spaced portions.

8. The improvement according to claim 6 wherein said rolls are substantially identical with each other and are inclined in opposite directions to a medial plane of the machine.

9. The improvement according to claim 8 wherein respective end portions of the rolls which are of the same form are situated remotely from each other.

10. In a method of straightening elongate material having a circular profile wherein the material is passed along a path defined between a pair of mutually inclined rolls and the material is rotated about its own axis and is advanced along said path by the rolls, the improvement wherein the material is bent by said rolls in opposite coplanar directions at two positions along said path.

11. A pair of rolls for acting together on elongate material in performance of a method according to claim 10, each roll having an axis and comprising first and second portions which are spaced apart axially and each of which portions has a peripheral surface which is a respective surface of revolution about the axis, wherein the first portion has a generatrix which is part of an hyperbola and the generatrix of the second portion is a part of another hyperbola.

* * * * *